US011466913B2

(12) United States Patent
Sigl et al.

(10) Patent No.: US 11,466,913 B2
(45) Date of Patent: Oct. 11, 2022

(54) ICE MAKER COMPRISING SPECIFIC COOLING OF A STORAGE CONTAINER AND HOUSEHOLD COOLING APPLIANCE

(71) Applicant: BSH HAUSGERAETE GMBH, Munich (DE)

(72) Inventors: Mathias Sigl, Herbrechtingen (DE); Jorge Carlos Montalvo Sanchez, Knoxville, TN (US); Julio Cesar Schmidt, Knoxville, TN (US); Marco Marques, Knoxville, TN (US)

(73) Assignee: BSH Hausgeraete GmbH, Munich (DE)

( * ) Notice: Subject to any disclaimer, the term of this patent is extended or adjusted under 35 U.S.C. 154(b) by 35 days.

(21) Appl. No.: 16/993,331

(22) Filed: Aug. 14, 2020

(65) Prior Publication Data

US 2021/0207863 A1 Jul. 8, 2021

Related U.S. Application Data

(63) Continuation-in-part of application No. 16/733,288, filed on Jan. 3, 2020.

(51) Int. Cl.

| | |
|---|---|
| ***F25C 1/04*** | (2018.01) |
| ***F25C 5/182*** | (2018.01) |
| ***F25D 17/06*** | (2006.01) |

(52) U.S. Cl.

CPC ..... *F25C 1/04* (2013.01); *F25C 5/182* (2013.01); *F25D 17/062* (2013.01); *F25C 2400/10* (2013.01); *F25C 2500/06* (2013.01); *F25D 2317/061* (2013.01); *F25D 2321/1441* (2013.01)

(58) Field of Classification Search

CPC ..... F25D 2317/061; F25D 17/062; F25D 2317/06; F25D 2321/144; F25C 1/04; F25C 2400/10; F25C 5/182; F25C 5/18

See application file for complete search history.

(56) References Cited

U.S. PATENT DOCUMENTS

| | | | | |
|---|---|---|---|---|
| 9,482,458 | B2 | 11/2016 | Jeong et al. | |
| 2011/0203305 | A1* | 8/2011 | Schenk | F25C 1/08 62/344 |
| 2018/0231294 | A1* | 8/2018 | Song | F25C 1/04 |
| 2019/0011166 | A1* | 1/2019 | Bertolini | F25C 5/22 |

* cited by examiner

*Primary Examiner* — Elizabeth J Martin

(74) *Attorney, Agent, or Firm* — Laurence A. Greenberg; Werner H. Stemer; Ralph E. Locher

(57) ABSTRACT

An ice maker for mounting into a household cooling appliance, the ice maker includes an ice producer for producing ice; a storage container for storing ice; a driving unit for driving the storage container, the driving unit having a drive housing; and an air duct formed in the drive housing. The air duct has an air duct outlet configured in a front wall of the drive housing which faces towards the storage container and an air duct inlet provided in a side wall of the drive housing which faces towards the ice producer. A fan is arranged in the air duct. The fan generates an air stream from the ice producer to the storage container through the air duct.

25 Claims, 12 Drawing Sheets

ICE MAKER COMPRISING SPECIFIC COOLING OF A STORAGE CONTAINER AND HOUSEHOLD COOLING APPLIANCE

CROSS-REFERENCE TO RELATED APPLICATION

This application claims the priority, under 35 U.S.C. § 120, of non-provisional patent application Ser. No. 16/733,288 filed Jan. 3, 2020; the prior application is herewith incorporated by reference in its entirety.

BACKGROUND OF THE INVENTION

Field of the Invention

One aspect of the invention relates to an ice maker. A further aspect relates to a household cooling appliance.

U.S. Pat. No. 9,482,458 B2 describes an ice maker comprising an air guidance for guiding cold air. However, the air guidance is very undefined. Thereby also air can find its way into a storage container of the ice maker, in which ice form elements are stored. Thereby it is also possible that a corresponding air stream flows against or around the produced ice form elements in the storage container. The ice form elements due to sublimation release vapors. Since the air stream can also enter the storage container, by the air stream the distribution of these vapors is enforced, which however should be avoided.

BRIEF SUMMARY OF THE INVENTION

It is accordingly an object of the invention to provide an ice maker, which overcomes the above-mentioned and other disadvantages of the heretofore-known devices and methods of this general type and which provides for an ice maker, in which the entry of an air stream into a storage container of the ice maker is reduced. It is a further object of the invention to provide a household cooling appliance with an ice maker in which the entering of an air stream into a storage container of the ice maker is reduced.

With the above and other objects in view there is provided, in accordance with the invention, an ice maker for mounting into a household cooling appliance. The ice maker comprises:

- an ice producer for producing ice,
- a storage container for storing ice,
- a driving unit for driving said storage container, wherein said driving unit having a driving housing,
- an air duct arranged in said drive housing, wherein the air duct having an air duct outlet provided in a front wall of said drive housing which faces to the storage container and an air duct inlet provided in a side wall of said drive housing which faces to the ice producer, and
- a fan arranged in the air duct, wherein the fan is configured to generate an air stream from the ice producer to the storage container through the air duct.

With the above and other objects in view there is also provided, in accordance with the invention, a household cooling appliance with an ice maker. The ice maker comprises: an ice producer for producing ice, a storage container for storing the ice, a driving unit for driving said storage container, wherein said driving unit has a drive housing, and the housing is formed with an air duct. The air duct has an air duct outlet provided in a front wall of the drive housing which faces to the storage container and an air duct inlet provided in a side wall of the drive housing which faces to the ice producer. A fan is arranged in the air duct, and the fan is configured to generate an air stream from the ice producer to the storage container through the air duct.

According to another aspect of the present disclosure, wherein the air duct is curved, at least in portions thereof, in an arch shape for guiding the air stream from the air duct inlet to the air duct outlet.

According to another aspect of the present disclosure, wherein the air duct is positioned above a drive motor in the drive housing.

According to another aspect of the present disclosure, wherein the fan is mounted inside the air duct and at the air duct inlet.

According to another aspect of the present disclosure, wherein the air duct having first air duct shell and second air duct shell, and the first air duct shell and the second air duct shell forming the air duct.

According to another aspect of the present disclosure, wherein the first air duct shell and the second air duct shell having a U-shaped form respectively and being connected together by plug connections which are integrally formed with the first air duct shell and second air duct shell.

According to another aspect of the present disclosure, wherein the fan is sandwiched between the first duct shell and the second air duct shell, and wherein the fan is provided in a circumferential groove formed by the first air duct shell and the second air duct shell.

According to another aspect of the present disclosure, wherein the air duct is narrowed in flow cross-section from the air duct inlet to the air duct outlet.

According to another aspect of the present disclosure, wherein the air stream exiting from the air duct outlet is further guided by an air guiding duct disposed above the storage container in a height direction of the ice maker, the air guiding duct being bounded by a first lateral duct wall that is oriented in the depth direction of the ice maker and extends in the height direction, and the air guiding duct being bounded by a second duct wall, being a roof wall.

According to another aspect of the present disclosure, wherein the air guiding duct having at least one first opening that is open towards the bottom to enable the air stream streaming in the air guiding duct to escape towards the bottom from the air guiding duct, According to another aspect of the present disclosure, wherein the at least one first opening of the air guiding duct is offset in a width direction of the ice maker so that the air stream exiting from the at least one first opening of the air guiding duct flows along the storage container on the outer side back to the ice producer.

According to another aspect of the present disclosure, wherein the air stream exiting from the opening of the air guiding duct flows along an outer side of a first side wall of the storage container and an outer side of a bottom wall of the storage container and an outer side of a second side wall of the storage wall, wherein the bottom wall is opposite the opening of the storage container that is accessible from above.

According to another aspect of the present disclosure, wherein at least the first lateral duct wall and the roof wall are configured to guide the air stream in the air guiding duct in the depth direction of the ice maker.

According to another aspect of the present disclosure, wherein the first lateral duct wall and the roof wall are a single-piece duct part.

According to another aspect of the present disclosure, wherein the first lateral duct wall is curved, at least in portions thereof, in an arch shape.

According to another aspect of the present disclosure, wherein the first lateral duct wall, viewed in the depth direction, is curved in a rear shell of a length thereof towards the interior of the ice maker.

According to another aspect of the present disclosure, wherein the air guiding duct comprises a second lateral duct wall, which bounds the air guiding duct at a side opposite the first lateral duct wall.

According to another aspect of the present disclosure, further comprising an outer housing wall forming the second lateral duct wall.

According to another aspect of the present disclosure, wherein the roof wall comprises a contact flange in direct contact with the second lateral duct wall.

According to another aspect of the present disclosure, wherein the air guiding duct comprises a rear end and an opposite front end, and the air guiding duct is narrowed from the rear end towards the front end.

According to another aspect of the present disclosure, wherein the air guiding duct is connected with a rear end to the drive housing.

According to another aspect of the present disclosure, wherein the air guiding duct is arranged at the drive housing by a stick connection.

According to another aspect of the present disclosure, wherein the air guiding duct, in the width direction of the ice maker, is arranged to overlap in portions in an overlapping area with the opening of the storage container, wherein the air guiding duct includes a bottom wall, by which the opening of the storage container is covered from the top in the overlapping area.

According to another aspect of the present disclosure, wherein the at least one first opening of the air guiding duct is formed in the bottom wall, and in the width direction is arranged external to the overlapping area.

According to another aspect of the present disclosure, wherein the ice maker forming an ice compartment arranged in a refrigeration compartment of a household cooling appliance.

Further features of the invention are apparent from the claims, the figures and the description of figures. The features and feature combinations mentioned above in the description as well as the features and feature combinations mentioned below in the description of figures and/or shown in the figures alone are usable not only in the respectively specified combination, but also in other combinations without departing from the scope of the invention. Thus, implementations are also to be considered as encompassed and disclosed by the invention, which are not explicitly shown in the figures and specifically described, but arise from and can be generated by separated feature combinations from the explained implementations. Implementations and feature combinations are also to be considered as disclosed, which thus do not comprise all of the features of an originally formulated independent claim. Moreover, implementations and feature combinations are to be considered as disclosed, in particular by the implementations set out above, which extend beyond or deviate from the feature combinations set out in the back-references of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the figures, identical or functionally identical parts are provided with the same reference signs.

With indications of "top," "bottom," "front," "rear," "horizontal," "vertical," "depth direction," "width direction," "height direction," etc., the positions and orientations given in intended use and intended arrangement of the apparatus are specified.

Figure 1:
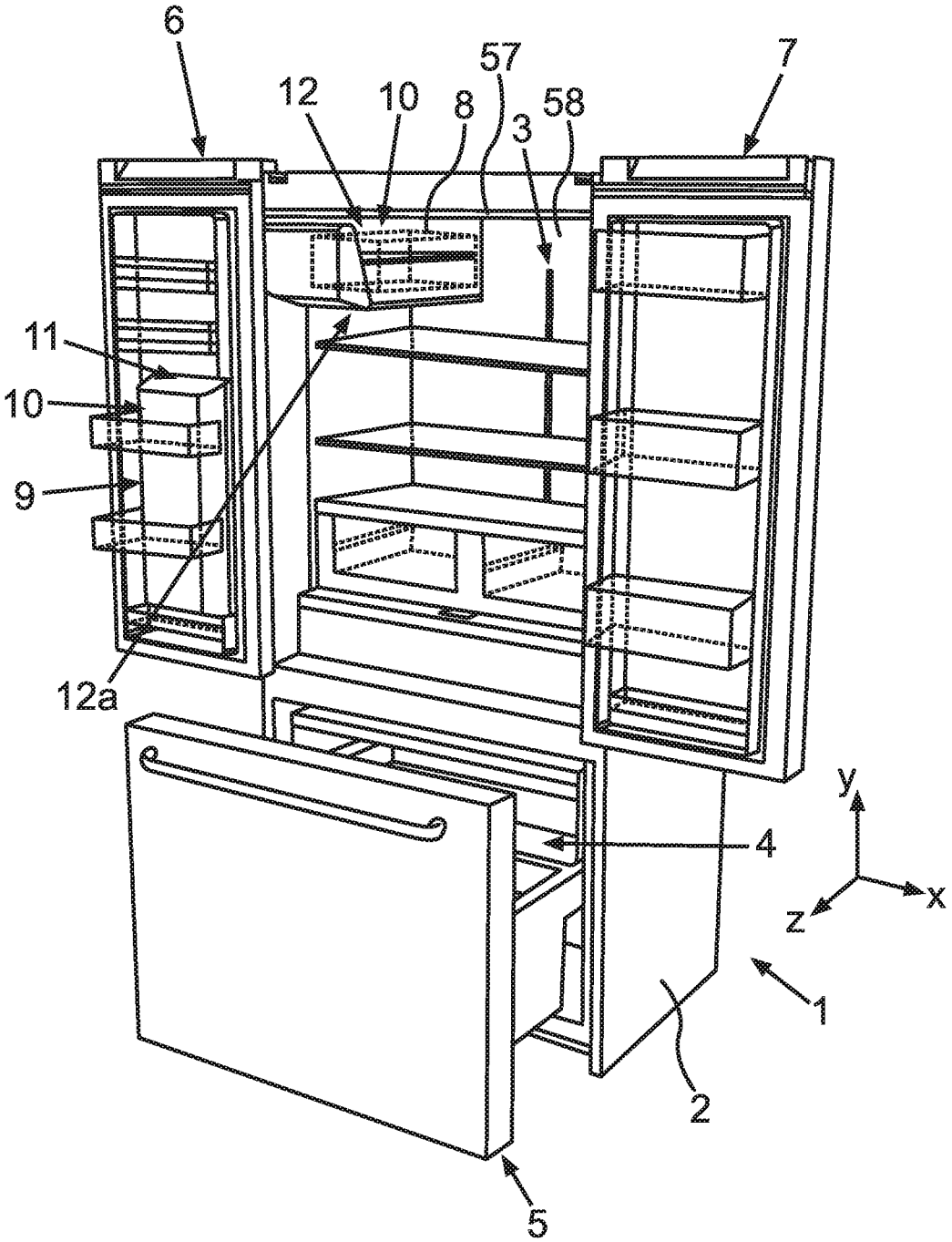
FIG. 1 is a perspective view of an embodiment of a household cooling appliance according to the invention.

In FIG. 1 in a perspective view an embodiment of a household cooling appliance 1 is shown. The household cooling appliance 1 is configured for storing and preserving food items. In the shown embodiment the household cooling appliance 1 is a fridge freezer combination appliance. However, it can also be only a cooling or refrigeration appliance.

The shown household cooling appliance 1 comprises an outer housing 2. In the outer housing a first receiving space for food items is configured, which here is a refrigeration compartment 3. In an embodiment the household cooling appliance 1 moreover comprises a second receiving space for food items, which is separate from the first receiving space and which here is a freezer compartment 4. As can be recognized, in the embodiment shown here the refrigeration compartment 3 and the freezer compartment 4 are arranged one above the other in the height direction (y-direction) of the household cooling appliance 1. The freezer compartment 4, which is arranged further below, is capable of being locked by a door 5. The door 5 in the shown embodiment is a front wall of a drawer, which can be shifted linearly in the depth direction (z direction) of the household cooling appliance 1. The refrigeration compartment 3 is capable of being locked by two separate doors 6 and 7, which are shown in FIG. 1 in the opened state. The two separate doors 6 and 7 are capable of being pivoted about pivot axles, which are vertically oriented, and are arranged on the outer housing 2. The two doors 6 and 7 are arranged adjacent to each other in the width direction (x direction) and extend in the closed state in a front side plane. In particular also the door 5 in the closed stated extends in this plane, in which also the two doors 6 and 7 extend in the closed state.

In an embodiment the household cooling appliance 1 moreover comprises a dispenser 10 configured to output ice form elements or crushed ice. The dispenser 10 moreover can also optionally be configured to output a drink. In an embodiment the household cooling appliance 1 comprises a module 8. In an embodiment the dispenser 10 comprises said module 8.

The module 8 in the shown embodiment is arranged in the interior of the refrigeration compartment 3. This means that whilst the module 8 is arranged to be thermally insulated against the refrigeration compartment 3, however, that it is only accessible and reachable via the feed opening of the refrigeration compartment 3. Thus, the module 8 can only be made accessible, when at least the door 6 is opened.

The dispenser 10 in addition to the module 8 also comprises an output 9. The output 9 here is for instance configured to be integrally formed in the door 6. On an outer side of the door 6, which faces away from the refrigeration compartment 3 and then is also a front side, a niche is formed, in which a receiving container can be placed and in which then via the output 9 the ice form elements or the crushed ice can be output.

In the closed state of the door 6 the output 9 is coupled with the module 8 so that via an ice chute 11 formed here in the output 9 ice form elements or crushed ice can arrive at the output 9 from the module 8.

The module 8 can be an ice compartment 12*a*. The household cooling appliance 1 can then also be configured without an ice maker 12. The module 8 can also be an ice maker 12. The ice compartment 12*a* can be an integral part of the ice maker 12 if the household cooling appliance 1 comprises an ice maker 12.

In FIG. 1 an example for a household cooling appliance 1 comprising an ice maker 12 is schematically shown. The ice maker 12 is arranged in the refrigeration compartment 3. Viewed from the front side, it is arranged in a left top corner portion of the refrigeration compartment 3. The ice maker 12 is arranged to be thermally insulated from the remaining volume of the receiving space 3. The ice maker is only accessible, if the door 6 is opened.

Figure 2:
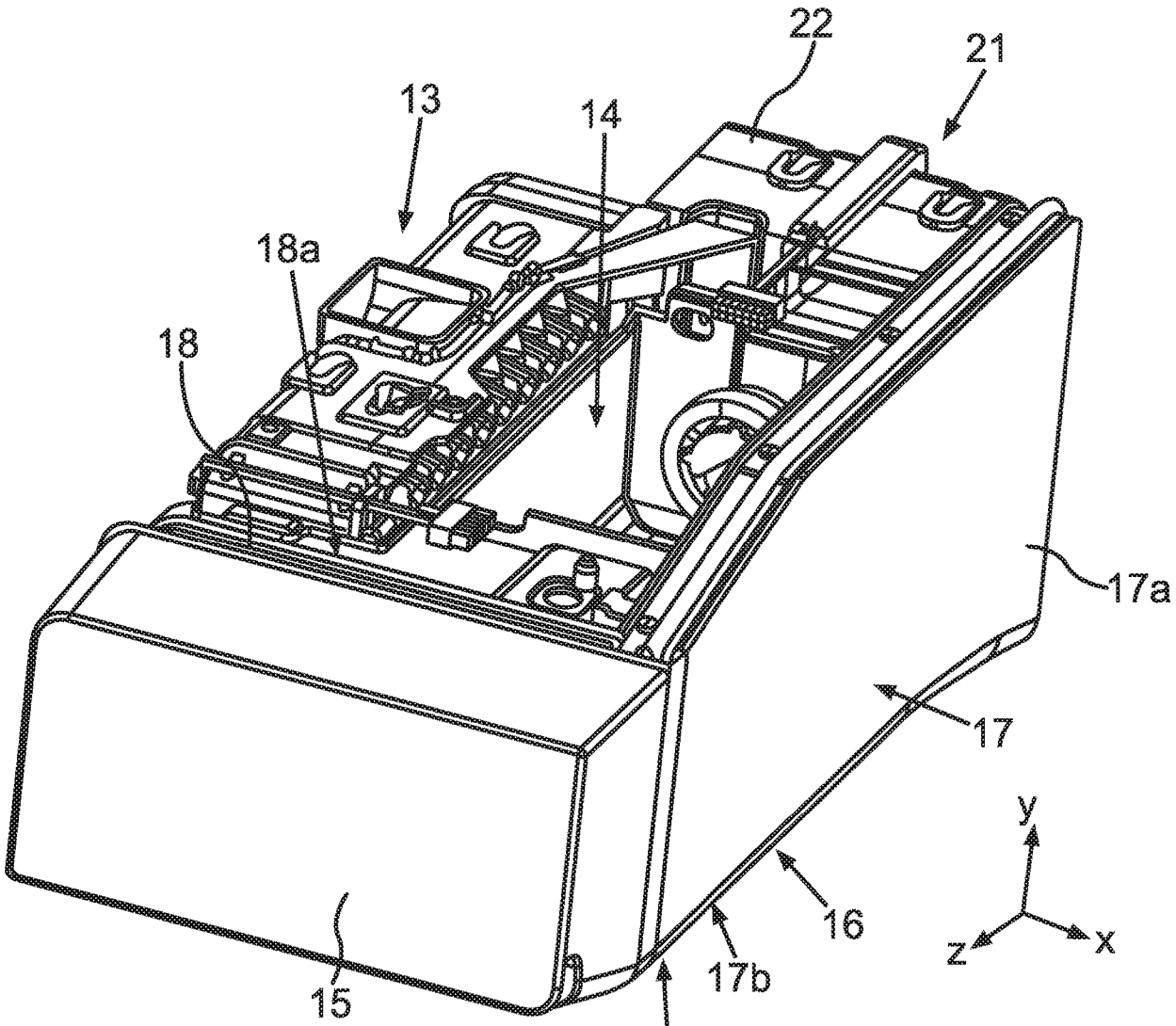
FIG. 2 is a perspective view of an embodiment of an ice maker according to the invention.

In FIG. 2 in a perspective view an embodiment of the ice maker 12 is shown. The ice maker 12 comprises an ice producer 13. Moreover, the ice maker 12 comprises a storage container 14. In the storage container 14 the ice form elements produced in the ice producer 13 can be stored. In FIG. 2 a conveyor 79 (FIG. 11) is not shown. The conveyor 79 is arranged in the storage container 14. In an embodiment the conveyor 79 is part of the ice compartment 12*a*. The conveyor 79 can be part of the ice maker 12. By the conveyor 79 the ice form elements stored in the storage container 14 are ejected from the ice maker 12 on demand. They then can be output via the ice chute 11 into the corresponding front side niche in the door 6. The storage container 14 is connected with a front wall 15 of the ice maker 12. The front wall 15 also represents a front wall of an outer housing 16 of the ice maker 12. The outer housing 16 moreover comprises an outer housing wall 17. The outer housing wall 17 is configured to be thermally insulated. The outer housing wall 17 is configured to comprise a vertical wall 17*a* and a bottom wall 17*b* integrally formed therewith. In particular the outer housing wall 17 is configured with an L-shape.

In particular the front wall 15 is configured to be separate from the outer housing wall 17. Preferably the ice maker 12 comprises a front frame 18. The front frame 18 is configured to be separate from the front wall 15. The front frame 18 is connected in particular with the outer housing wall 17. In the mounted state, as shown in FIG. 2, the front wall 15 contacts the front frame 18 directly. The front frame 18 can then also be referred to as front flange. In particular the front wall 15 is pushed, in particular pressed to the front frame 18. Thereby a sealing state is achieved. In particular between the front wall 15 and the front frame 18 a sealing 19 (FIG. 11) is arranged. The sealing 19 is in particular a sealing that is configured to be completely circumferentially extending or almost completely circumferentially extending. It can be arranged on a rear side 20 (FIG. 11) of the front wall 15. The front frame 18 is circumferentially closed. Thereby an opening 18*a* bounded by the front frame 18 is rendered. By this opening 18*a* the storage container 14 is inserted into the outer housing 16 from the front side.

Moreover, the ice maker 12 comprises a driving unit 21. The driving unit 21 is in particular configured to drive the conveyor 79 already mentioned in the above. In particular here a driving by a drive motor is envisaged. Moreover, it may be envisaged that the driving unit 21 is configured for generating an air stream in the ice maker 12. In particular here a cold air stream should be generated. The driving unit 21 is a separate module. The driving unit 21 thus is configured to be separate from the ice producer 13 and separate from the storage container 14. In the embodiment it is arranged at the rear end of the ice maker 12 viewed in the depth direction (z direction). The driving unit 21 comprises a drive housing 22. In the drive housing 22 functional units are arranged. A functional unit of the driving unit 21 can for instance be a fan for generating the air stream. A functional unit, however, can also be for instance a drive motor for driving the conveyor 79. The functional unit, however, for instance can also be an air duct.

Figure 3:
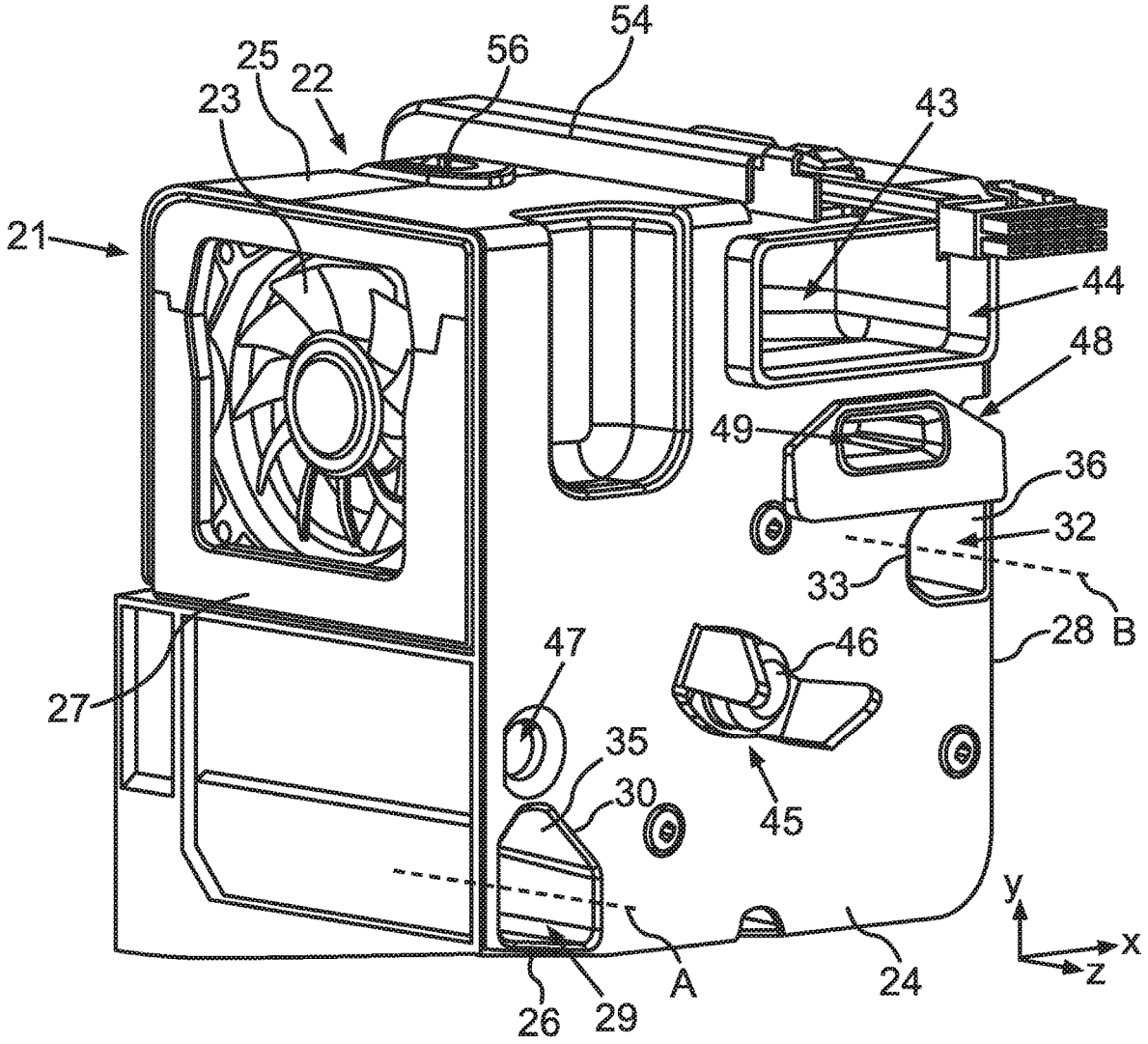
FIG. 3 is a perspective view of an embodiment of a driving unit of an ice maker.

In FIG. 3 in a perspective view the driving unit 21 is shown in an embodiment. Exemplarily, here also a fan 23 is shown, which is arranged in the drive housing 22. The drive housing 22 comprises a front wall 24. Moreover, the drive housing 22 comprises a roof wall 25 as well as a bottom wall 26. Moreover, viewed in the width direction (x-direction), also side walls 27 and 28 are provided. In particular the drive housing 22 forms a cuboid shape. The drive housing 22 with regard to this shape is configured to have a housing wall at each side. Further the roof wall comprises an integrated cable channel 54.

The drive housing 22 of the drive unit 21 may comprise a plurality of single housings, which are assembled and mounted to each other. That means that the drive housing 22 may be formed, in an exemplary embodiment, of separate housings for the various functional units, for example for the fan 23 and air duct 43, which are mounted to and carried by the drive motor housing. In this way, the drive housing 22 comprise an assembly of single housings of the various functional units which are mounted to and carried by the housing of the drive motor of the driving unit 21.

The driving unit 21 comprises a first receiving duct 29. The receiving duct 29 is configured for receiving a first fastening part that is separate thereto to extend completely through the receiving duct 29. The fastening part, which is not shown in FIG. 3, can be a screw or a rivet or a bolt. Also a snapper or a bayonet part for generating a bayonet lock is feasible as fastening part. This fastening part can be inserted from the front through an entry 30 of the receiving duct 29. The receiving duct 29 is formed as a single piece with the drive housing 22. The first fastening part can then be inserted in the first receiving duct 29 in the depth direction towards the back. The first receiving duct 29, as this can be recognized in the front view on the front side 24 in FIG. 4, comprises a rear exit 31. The first receiving duct 29 extends in particular across the entire depth of the drive housing 22. The first receiving duct 29 thus is configured to extend completely through the drive housing 22, wherein this extension is viewed in the depth direction. The exit 31 is equally configured to be open towards the front. Thereby the fastening part can extend towards the rear out of the drive housing 22. By this first receiving duct 29 it is facilitated that the driving unit 21 can be mounted external to the ice maker 12. This means that the driving unit 21 can be fastened to a component of the household cooling appliance 1 that is different to the ice producer 13 and the storage container 14 and the wall 17. By the above-named exemplary fastening parts here a simple non-destructively releasable connection can be achieved. Thereby, a simple mounting concept is facilitated. In particular it is thereby facilitated that a specific module of the ice maker, namely the driving unit 21 itself, can be individually fastened and thus can also be individually fastened at such a component of the household cooling appliance 1. Thereby the most varied individual mounting options and positioning of the driving unit 21 relative to other components of the ice maker 12 are also rendered possible in an improved way. The driving unit 21 can also be referred to as driving unit module or driving unit station.

The first receiving duct 29, as this has already been set out in the above, extends across the entire depth of the drive housing 22. It is configured to be open both at its front end or the entry 30 as well as at its rear end or the exit 31. Moreover the driving unit 21 comprises a second receiving duct 32 (FIG. 3). The second receiving duct 32 is separate and spaced from the first receiving duct 29. In particular also the second receiving duct 32 is integrated in the drive housing 22. It, too, is thus integrally formed therewith. The second receiving duct 32 equally comprises a front side entry 33. It equally extends in the depth direction up to the rear end of the drive housing 22. Also the second receiving duct 32 thus extends across the entire depth of the drive housing 22. As can be recognized in FIG. 4, the second receiving duct 32 comprises a rear exit 34. This exit 34 is open. Thereby, a further fastening part can be provided, which can be inserted through the entry 33 and can project through the exit 34 and the drive housing 22 towards the rear. Also it is thereby facilitated that the driving unit 21 can be fastened to a component that is separate from the driving unit 21. This means that the driving unit 21 can be fastened to a component of the household cooling appliance 1 that is different to the ice producer 13 and the storage container 14 and the wall 17. This component, to which the driving unit 21 is fastened by means of the second fastening part, which is inserted into the second receiving duct 32 and extends through it, is the same component, to which the driving unit 21 can be fastened by the first fastening part, which is inserted into the first receiving duct 31.

As can be recognized in FIG. 3, the first receiving duct 29 is oriented with its longitudinal axis A in the depth direction. The same is true for the second receiving duct 32, which is oriented with its longitudinal axis B in the depth direction. The longitudinal axes A and B are in particular oriented in parallel to each other. In the circumferential direction around the longitudinal axis A the first receiving duct 29 is fully bounded by bounding walls 35. The same is envisaged for the second receiving duct 32. It, too, in the circumferential direction around its longitudinal axis B is fully bounded by bounding walls 36. The receiving ducts 29 and 32 thus are designed to be tunnel-like or tube-like.

Figure 4:
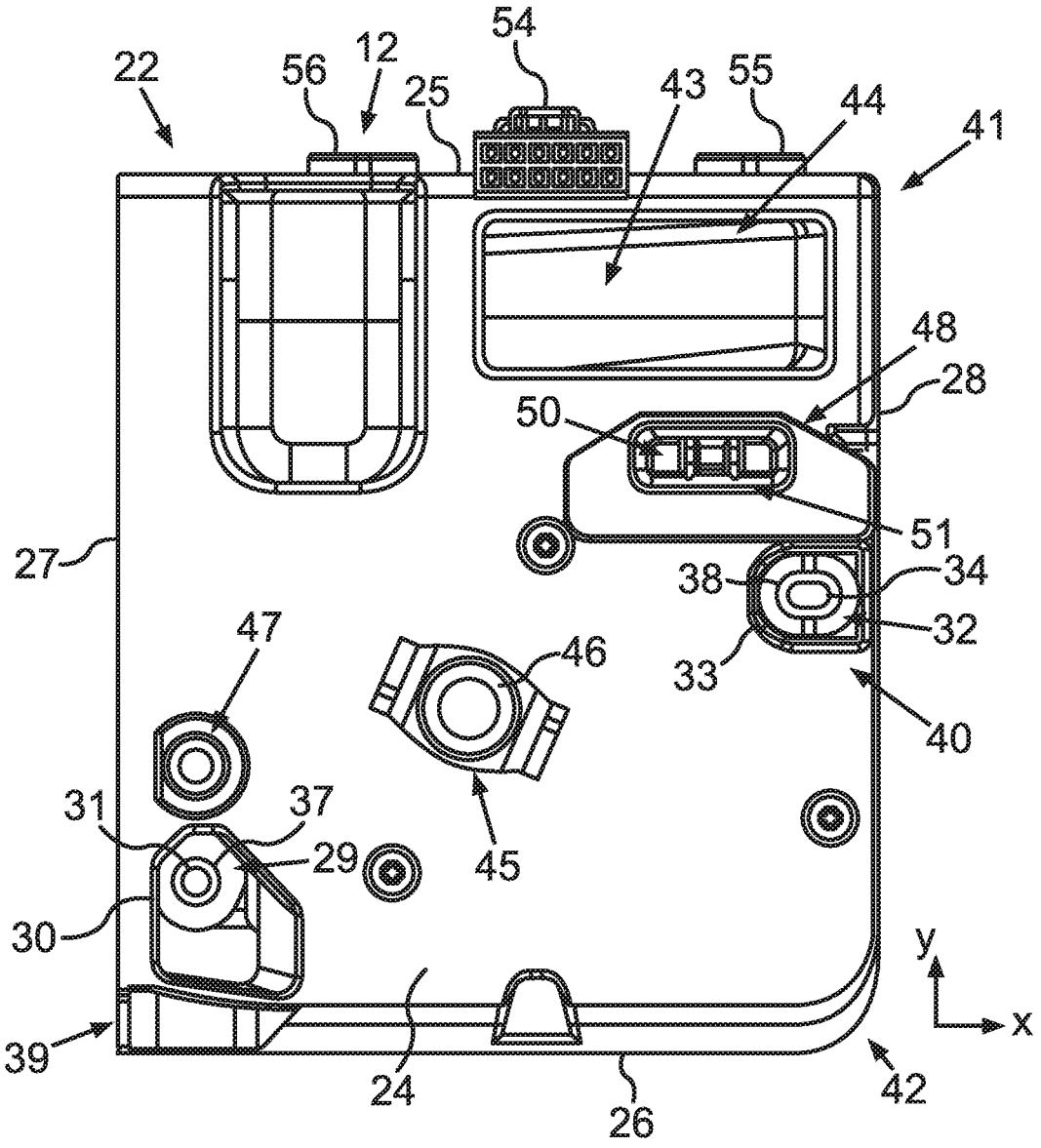
FIG. 4 is a front view of the drive unit according to FIG. 3.

As can be recognized in FIG. 4, the exit 31 is configured to be constricted, in comparison with entry 30. This means that the rear opening or the inner width of the exit 31 is smaller in terms of surface than is the case with the entry 30. In particular it is envisaged that for this purpose a throat 37 or a constriction is configured. Thereby it is achieved that a fastening part with a broadened fastener head can be inserted via the entry 30 into the first receiving duct 29. However, this fastener head is retained to the exit 31. This means that the fastener head cannot be inserted through the exit 31. This is because the exit 31 with its recess hole is dimensioned too small for the fastener head to be capable of being passed through. This is achieved by the throat 37. The throat 37 can for instance also at least in portions be configured to be funnel-like or cone-shaped. Thereby a correspondingly complementarily shaped fastening head can be arranged to be recessed. Thereby the mechanical retention force is increased. Correspondingly, this can be envisaged for the second receiving duct 32. In particular here, too, the exit 34 in comparison with its entry 33 is configured to be constricted. Here, too, correspondingly a throat 38 or constriction can be envisaged. Also this is configured with regard to avoiding a passage or slipping of a fastener head of the further fastening part.

As can be recognized in FIG. 3 and FIG. 4, the two receiving ducts 29 and 32 are arranged offset relative to each other in the height direction (y direction). Additionally or instead, these receiving ducts 29 and 32 are offset relative to each other also in the width direction (x direction). In particular here they are maximally offset relative to each other. The first receiving duct 29 is preferably arranged in a bottom left corner portion 39 of the drive housing 22. This is configured when viewing the front wall 24 from the front side. Preferably the second receiving duct 32 is formed in a lateral edge portion 40 of the drive housing 22. Moreover, in an advantageous embodiment it is configured to be at a distance from a top corner portion 41 and at a distance from a bottom corner portion 42 of the drive housing 22. In particular the second receiving duct 32 is formed approximately half way up the height between the two corner portions 41 and 42.

The first receiving duct 29 comprises a, viewed in the depth direction, rear end portion **29*a* (FIG. 6), as this has already been explained in the above. In the depth direction viewed towards the front, the first receiving duct 29 comprises a front portion 29*b* extending therefrom. This rear end portion 29*a* comprises a constriction so that the rear end portion 29*a* viewed in the cross-section perpendicular to the longitudinal axis A is smaller than the front portion 29*b*. This constriction is formed by the throat 37 that has already been explained. This constriction or throat 37 in an advantageous embodiment forms a stop and a passage barrier for a head of the fastening part, as it has already been set out in the above. This fastener head therefore cannot slip through this constriction or this throat 37**.

The same is true in analogy for the second receiving duct 32. Here, too, the rear end portion and a front portion extending therefrom in the depth direction towards the front are configured. Here, too, the rear portion has a constriction or narrowing formed by the throat 38. Also, thereby the rear end portion is smaller than the front portion viewed in the cross-section perpendicular to the longitudinal axis B.

Moreover, the driving unit 21 comprises an air duct 43 positioned inside the drive housing 22. From this air duct 43 an air stream L generated by the fan 23 can be guided in the driving unit 21 and thus in the drive housing 22 in a defined way. This air duct 43 of the driving unit 21 comprises an air duct outlet 44. Same is configured in the embodiment in the front wall 24 of the drive housing 22. The air duct 43 is surrounded by said drive housing 22. The air duct 43 having an air duct outlet 44 provided in a front wall of the drive housing 22 facing the storage container 14 and an air duct inlet provided in a side wall of the drive housing 22 facing the ice producer 13. The fan 23 is arranged in said air duct 43, wherein said fan is configured to generate an air stream L from said ice producer 13 to said storage container 14 through said air duct 43.

In a further advantageous embodiment, it is envisaged that on the front wall 24 a passage 45 is formed. Through this passage 45 a shaft 46 of a drive motor 64 shown here (FIG. 7) can extend. The drive motor 64 can be arranged as functional unit in the drive housing 22. A conveyor 79 of the ice maker 12, which conveyor 79 has already been mentioned in the above and by which ice form elements can be conveyed out from the storage container 14, can be coupled by this shaft 46. Thereby the conveyor 79 is set in motion by the drive motor 64. For this purpose, the conveyor 79 can comprise a coupling part, which can be coupled in a non-destructively releasable manner to the shaft 46. However, it may also be envisaged that the coupling part extends through the passage 45 into the interior of the drive housing 22 and only in the interior of the housing 22 can couple to a shaft 46 of the drive motor 64.

In a further advantageous embodiment, it is envisaged that the driving unit 21 comprises a coupling entry 47 for mechanical coupling of the storage container 14 to the driving unit 21. For instance, the storage container 14 can comprise a coupling part at its rear side, which can be inserted into the coupling entry 47. Thereby a mechanical coupling and a position centering of the storage container 14 relative to the driving unit 21 is facilitated. Preferably this coupling entry 47 is configured immediately above the entry 30 of the first receiving duct 29. The coupling entry 47 can be integral part of a mechanical stick connection. However, it may also be integral part of a snap connection. The corresponding counter coupler 80 (FIG. 11), which is arranged at the storage container 14, then forms the respective counterpart for generating the stick connection or the snap connection. The counter coupler 80 can be a coupling pin. The counter coupler 80 is preferably configured to be integrally formed with the storage container 14. In an embodiment the counter coupler 80 is said coupling part.

In a further advantageous embodiment, it may be envisaged that the driving unit 21 comprises a closing aid 48. This closing aid 48 can be configured as a separate module of its own. The closing aid 48 allows for the driving unit 21 with the storage container 14 to be held fixed in position. In particular here a self-locking principle is facilitated so that the storage container 14 in the depth direction is led via a certain path independently to the driving unit 21, in particular drawn into the drive housing 22. In an advantageous embodiment it is thereby rendered possible that the front wall 15, which is firmly connected with the storage container 14, equally automatically is drawn in the depth direction towards the rear. Thereby the front wall 15 with a defined pressing force is pressed to the front frame 18 or pulled towards the rear and a corresponding pressing force generated between the named components.

The closing aid 48 comprises an insertion opening 49, as it can be recognized in FIG. 3. This insertion opening 49 is formed in the front wall 24. In an embodiment this insertion opening 49, viewed in the height direction, is configured above the second receiving duct 32. In particular this insertion opening 49, viewed in the height direction, is configured below the air duct outlet 44. Viewed in the width direction, this insertion opening 49, when viewing the front wall 24 from the front side, is configured to be adjacent to the edge portion 40. Thereby, viewed quasi in the height direction, in a sequence from top to bottom the arrangement of the air duct outlet 44, the insertion opening 49, and the entry 33 of the second receiving duct 32 is rendered. Preferably, the insertion opening 49 is arranged in a top half of the height, wherein here the height of the front wall 64 is viewed. The closing aid 48 can be configured as separate module of its own, which is inserted into the drive housing 22.

In FIG. 4 according to the viewing from the front side the closing aid 48 is shown. The insertion opening 49 can be recognized. The closing aid 48 comprises a gripper 50, which can be recognized in the representation in FIG. 4. It is positioned inside the closing aid 48 and thus arranged to be offset towards the rear in the interior of the housing 22. Moreover, the closing aid 48 comprises a loaded energy storage 51. The energy storage 51 is arranged in the interior of the 48 and cannot be recognized in the representation shown in FIG. 4. It is therefore only indicated by the corresponding reference sign. By the energy storage 51 a snapping-over of the gripper 50 from a basic position into a snap-over position is achievable, when the loaded energy storage 51 is changed from the loaded state to the unloaded state. This is effected by the fact that in case of an insertion of a coupling extension 52 (FIG. 11), which is arranged on a rear wall 53 (FIG. 11) of the storage container 14 and projects relative to the rear wall 53 towards the rear, into the insertion opening 49 of the coupling extension 52, contacts this gripper 50 in the basic position. By a further pushing of the storage container 14 towards the rear, the gripper 15 is pressed resp. turned towards the rear and thereby the loaded energy storage 51 is actuated. The gripper 50 during this contacting by the coupling extension 52, to start with, performs a rotary movement. The energy storage 51 is then released or then unload and the gripper 50 coupled therewith further performs a translational resp. linear movement towards the rear. By the operating principle the gripper 50 is automatically moved linearly towards the rear by the energy storage 51. By the coupling extension 52 already being coupled to the gripper 50, in the case of this automatic snapping-over of the gripper 50 a pulling along of the coupling extension 52 in the depth direction towards the rear is effected. This is also the automatic dynamic process of the storage container 14 in the depth direction, which is caused by this closing aid 48. The further mechanisms resulting therefrom, as has already been explained in the above, are thereby achieved. In particular this concerns the drawing of the storage container 14 to the front wall 24. In particular, however, this also concerns the sealing pressing of the front wall 15 to the front frame 18. Thus, an independent drawing of the front wall 15 into the locking position is effected. In particular thereby also the storage container 14 is independently drawn into the closed end position towards the rear. In the case of a returning of the gripper 50 to the basic position this is preferably effected by the fact that the front wall 15 with the storage container 14 is pulled in the depth direction towards the front. Thereby the gripper 50, which is coupled with the coupling extension 52, is drawn towards the front. This is a translational movement, which at its end transitions into a rotary movement of the gripper 50. Thereby the gripper 50 then reaches its basic position again. The energy storage 51 is loaded again by this movement of the gripper 50, as it is coupled to the gripper 50. In particular it is thereby pre-stressed. The energy storage 51 can be a spring. However, also a different mechanical energy storage can be provided.

Figure 5:
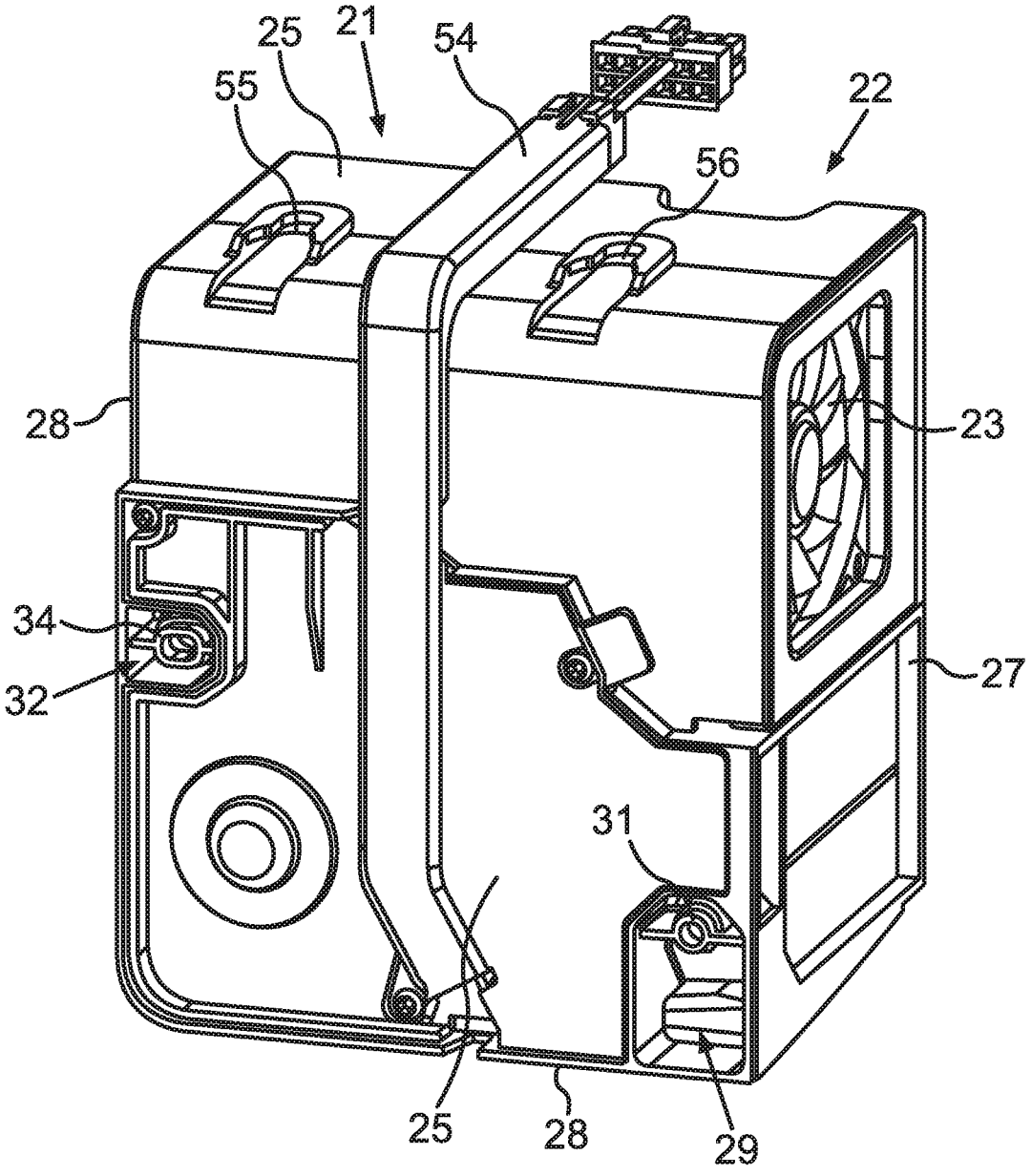
FIG. 5 is a further perspective view of the driving unit according to FIG. 3 and FIG. 4.

In FIG. 5 the driving unit 21 is shown once again as corresponding separate module. In FIG. 5 here the representation of the rear wall 25 of the drive housing 22 is shown. The exits 31 and 34 of the receiving ducts 29 and 32 can be recognized. The correspondingly constricted passages can be recognized.

Thereby in FIG. 5 in a manner corresponding to FIG. 2 and FIG. 3 it can be recognized that in the roof wall 25 of the drive housing 22 coupling entries 55 and/or 56 are formed. These coupling entries 55 and/or 56 can be engaged by counter couplers. Thus, the driving unit 21 can also be fastened to a ceiling wall 57 (FIG. 1) of an inner liner 59 of the household cooling appliance 1. In particular thereby a suspension can be effected. In addition to the non-destructively releasable connections to a rear wall 58 of this inner liner 59 by the fastening parts and the receiving ducts 29 and 32 thus an additional mechanical fastening to the inner liner 59 can be effected. In an embodiment thus the component, to which the driving unit 21 is fastened is the rear wall 58. This is effected by fastening parts, which are horizontally inserted into the receiving ducts 29 and 32. A further component, to which the driving unit 21 can be fastened, is the roof wall 57 of this inner liner 59. The inner liner 59 by its walls bounds the refrigeration compartment 3. In particular it bounds the refrigeration compartment 3 thereby directly.

Figure 6:
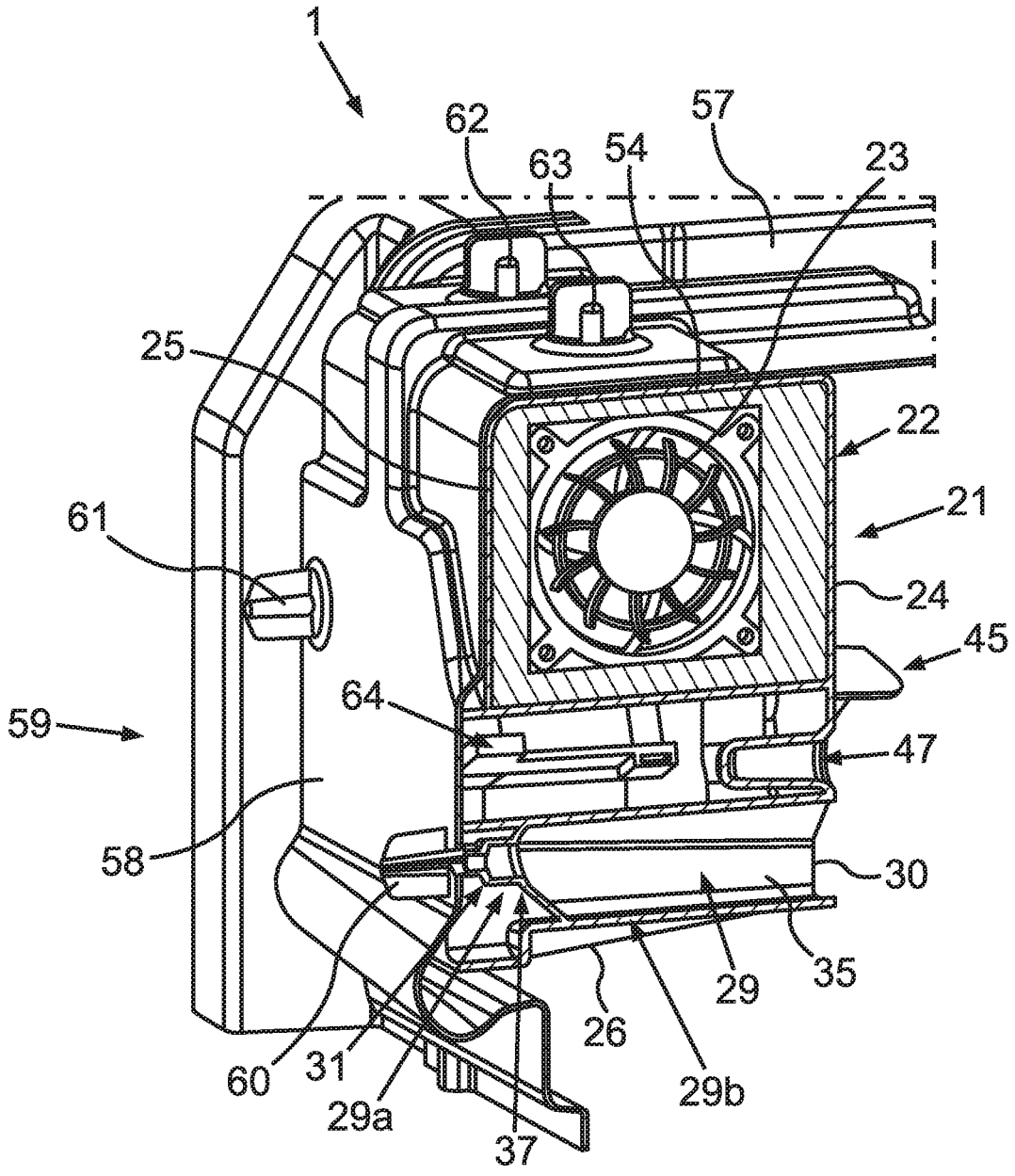
FIG. 6 is a perspective section view of the driving unit according to FIG. 3 to FIG. 5 in the installed state on a wall of an inner liner of the household cooling appliance.

In FIG. 6 in a perspective view a partial portion of the household cooling appliance 1 is shown. Here the inner liner 59 is partially shown. In particular the rear wall 58 and the roof wall 57 is shown. The driving unit 21 is shown in the installed state. In FIG. 6 a perspective sectional view is shown. The sectional plane here is drawn through the first receiving duct 29. As can be recognized, at an outer side of the rear wall 58 a reinforcement part 60 is arranged. This comprises a receiving portion, into which the fastening part (not shown) can be inserted. In particular this may for instance be a screw boss, into which a screw representing a fastening part can be screwed. Equally, this, however, can also be for instance a bolt duct or a rivet duct. Also, a socket for a snap connection can be configured in the reinforcement part 60. A further reinforcement part 61 can be recognized. Same is arranged in the portion at the rear side of the rear wall 58, on which the exit 34 of the second receiving duct 32 is arranged. Moreover, corresponding couplers 62 and 63 are shown as reinforcement parts that are arranged at the outer side of the roof wall 57 of the inner liner 59. Therein the corresponding options for coupling to the coupling entries 55 and 56 are facilitated. In the inserted state of a first fastening part into the first receiving duct 29 a head of a fastening part contacts the entry of the constriction or the throat 37 and extends towards the rear through the constricted rear end portion 29*a* of the first receiving duct 29 through the rear wall 58 into the reinforcement part 60. Accordingly, the second fastening part is arranged in the second receiving duct 32 and extends accordingly into the further reinforcement part 61.

For mounting, as this can be recognized in FIG. 6, a separate fastening part is pushed through via the front side of the ice compartment 12*a* or the ice maker 12, in particular through the front frame 18, and inserted into the first receiving duct 29. The module with the front wall 15 and the storage container 14 in this mounting state is not yet present. This first fastening part is then pushed within the receiving duct 29 far enough towards the rear to reach through the rear wall 58 and to be inserted into the reinforcement part 60. It is then correspondingly fastened so that a stable holding of the driving unit 12 is reached. The same is performed before or after with a second fastening part, which in an advantageous way is equally inserted through the front frame 18 in the depth direction and then introduced into the second receiving duct 32, is passed through the rear wall 58 and inserted into the reinforcement part 61.

Figure 7:
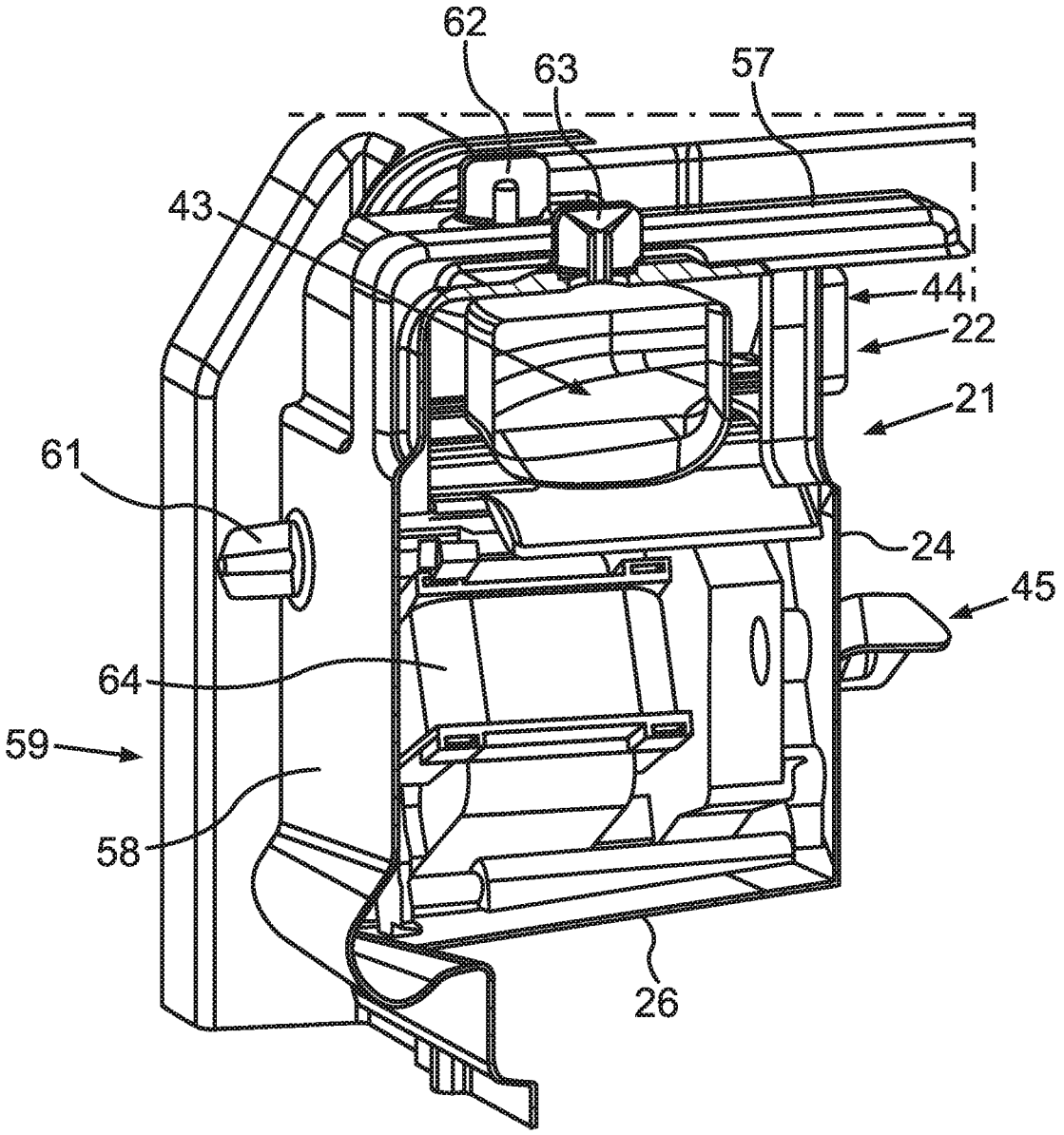
FIG. 7 is a perspective sectional view of the arrangement according to FIG. 6 in a sectional plane that is different therefrom.

In FIG. 7 a representation according to FIG. 6 is shown, with the sectional plane, however, being shown in a different way than in FIG. 6 partly through a coupler 63. The drive motor 64 can be recognized equally as in FIG. 6.

Figure 8:
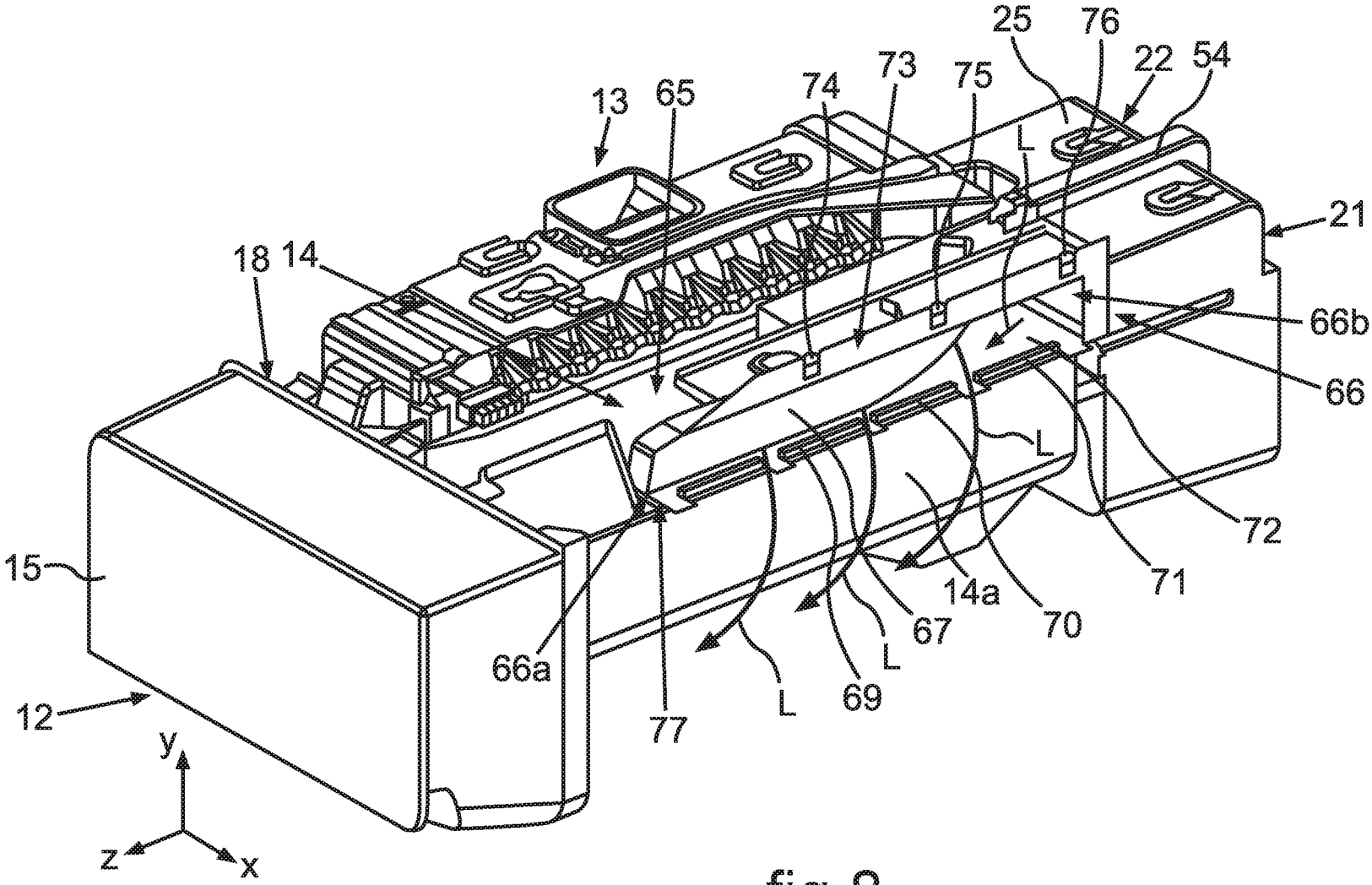
FIG. 8 is a perspective view of the ice maker with removed housing wall of an outer housing.

In FIG. 8 in a further perspective view the ice maker 12 is shown. The storage container 14 comprises an opening 65. The opening 65 is directed upward so that the storage container 14 is accessible from the top via this opening 65. The storage container 14 moreover has an outer side 14*a*. This is the outer side 14*a* of the walls of the storage container, which bound the volume of the storage container 14. The walls of the storage container 14 are a first side wall, a bottom wall that is adjacent to first side wall, and a second side wall that is adjacent to the bottom wall. The bottom wall is positioned opposite the opening 65, when viewed in the height direction. The storage container 14, viewed in a cross-section perpendicular to the depth direction, is configured to be U-shaped.

The ice maker 12 moreover comprises an air guiding duct 66. The air guiding duct 66 comprises a first lateral duct wall 67. This first lateral duct wall 67 extends in the depth direction of the ice maker 12 and extends in the height direction of the ice maker 12. The air guiding duct 66 moreover is bounded by a second duct wall 68. The second duct wall 68 is a roof wall. The air guiding duct 66 comprises at least one opening 69, which is open towards the bottom. In particular in an embodiment three such openings 69, 70, and 71 are configured. All of these are configured to be open towards the bottom. An air stream L flowing through the air guiding duct 66 by the geometry of the duct walls and their arrangement relative to each other is released from the air guiding duct 66 towards the bottom. This is effected by the openings 69, 70, and 71.

The air guiding duct 66, viewed in the width direction of the ice maker 12, is arranged offset relative to the opening 65 of the storage container 14. In particular this offset arrangement is such that the air stream L exiting from the first opening 69, 70, 71 of the air guiding duct 66 flows around the storage container 14 at its outer side 14*a*. In particular the arrangement of the first openings 69, 70, and 71 to the storage container 14, in particular its opening 65 toward the top, is such that no overlapping in the width direction is given. The exiting of the air stream L from the openings 69, 70, 71 thereby is not effected via the opening 65 into the storage container 14. The air stream L thus only flows around the storage container 14 at its outer side 14*a*.

In particular the air guiding duct 66 comprises a bottom wall 72. In this bottom wall 72 the first openings 69, 70, 71 are formed. Through the bottom wall 72 the opening 65 of the air guiding duct 66 is also covered in the portion, in which it overlaps in the width direction with the opening 65. Thereby no air stream flows through the opening 65 into the storage container 14. In particular by the first lateral duct wall 67 and the second duct wall 68 showing the roof wall the air stream L is conducted into the air conduction duct in the depth direction of the ice maker 12. The first lateral duct wall 67, the second duct wall 68, and in particular the bottom wall 72 are integrally formed with each other as a single piece. In particular a component 77 is thereby formed, in particular from plastic. The first lateral duct wall 67 is configured to be uneven. It is curved in an arch-shaped manner. In particular at the rear end facing the driving unit 62, in particular a rear half, an arch-shaped curvature is configured. A curvature is provided only in one direction. In particular the curvature is directed towards the ice producer 13.

Preferably the air guiding duct 66 comprises a second lateral duct wall bounding the air guiding duct 66 at the side opposite the first lateral duct wall 67. In particular this second lateral duct wall is formed by an outer housing wall of the outer housing 16 of the ice maker 12. The outer housing wall is in particular formed by the wall 17*a*, as it is shown in FIG. 2. This wall 17*a*, however, is a wall that is separate from the walls 67, 68, and 72. In the assembled state the component 77 with the walls 67, 68, and 72, viewed in the width direction, directly contacts the inner side of the outer housing wall 17*a*.

As can be recognized moreover in FIG. 8, the component 77 with the integrally formed walls 67, 68, and 72 comprises a flange 73. This flange 73 is in particular L-shaped. It is envisaged for contacting the inner side of the outer housing wall 17*a*. In an advantageous embodiment in this flange 73 resilient parts 74, 75, and 76 are configured to be integrally formed with each other as a single piece. Thereby in the mounted state a pressing of this 77 to the outer housing wall 17*a* is achieved.

Figure 9:
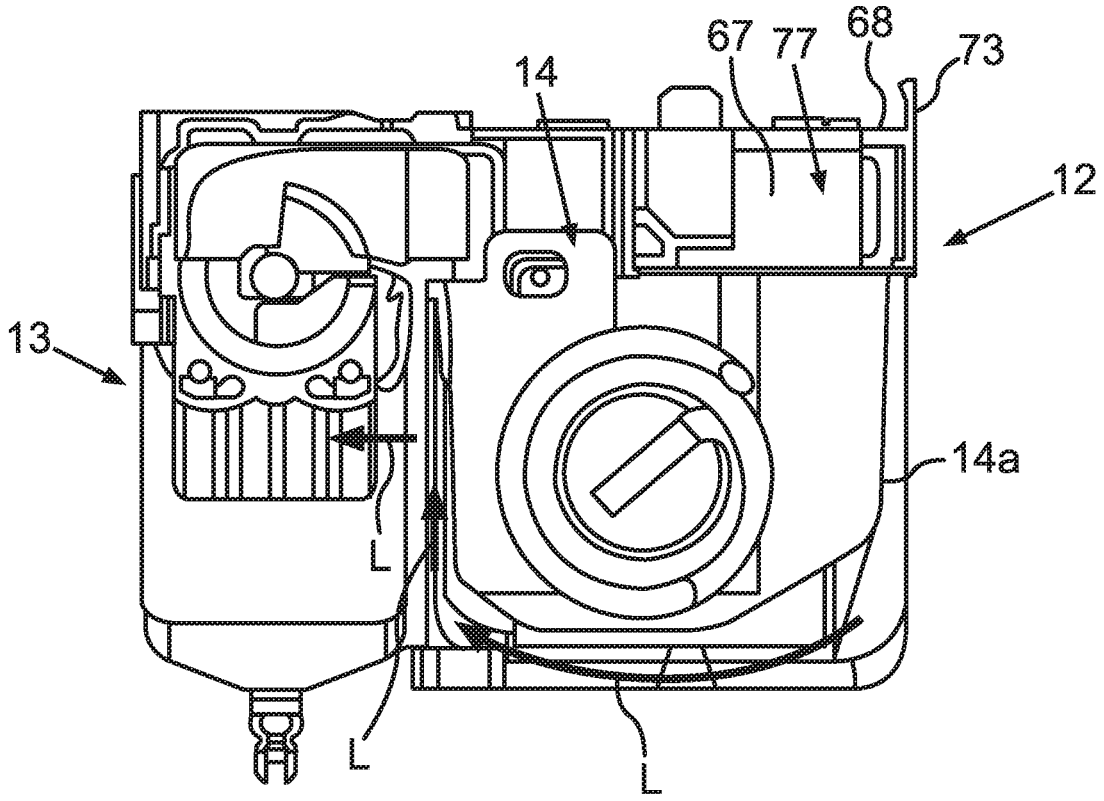
FIG. 9 is a vertical sectional view of the embodiment according to FIG. 8.

The component 77, which is formed as a single piece and comprises the walls 67, 68, and 72 as well as the flange 73, is arranged in non-destructively releasable manner at the driving unit 21. For this purpose, the driving unit 21 comprises a coupler oriented in the depth direction towards the front. This component is fitted upon this coupler. This component 77 in FIG. 9 is shown in the sectional view, as is the storage container 14 and the ice producer 13. The progression of the air stream L is shown in FIG. 9. It can be recognized that this fully flows around the storage container 14 at its outer side 14*a* and then enters the ice producer 13. The ice producer 13 is cooled by a cooling tube which also cools down the air flow coming back from the storage container 14. The cooled down air of the cooling tube, which is preferably provided on the lower portion of the ice producer 13, is sucked by the fan 23 and discharged to the storage container 14.

The air guiding duct 66, viewed in the depth direction, comprises a front end 66*a* and a rear end 66*b*. The air guiding duct 66 narrows, in particular continuously, starting from the rear end 66*b* towards the front up to the front end 66*a*. Thereby a pressing of the airstream L outward out of the openings 69, 70, 71 is supported.

Figure 10:
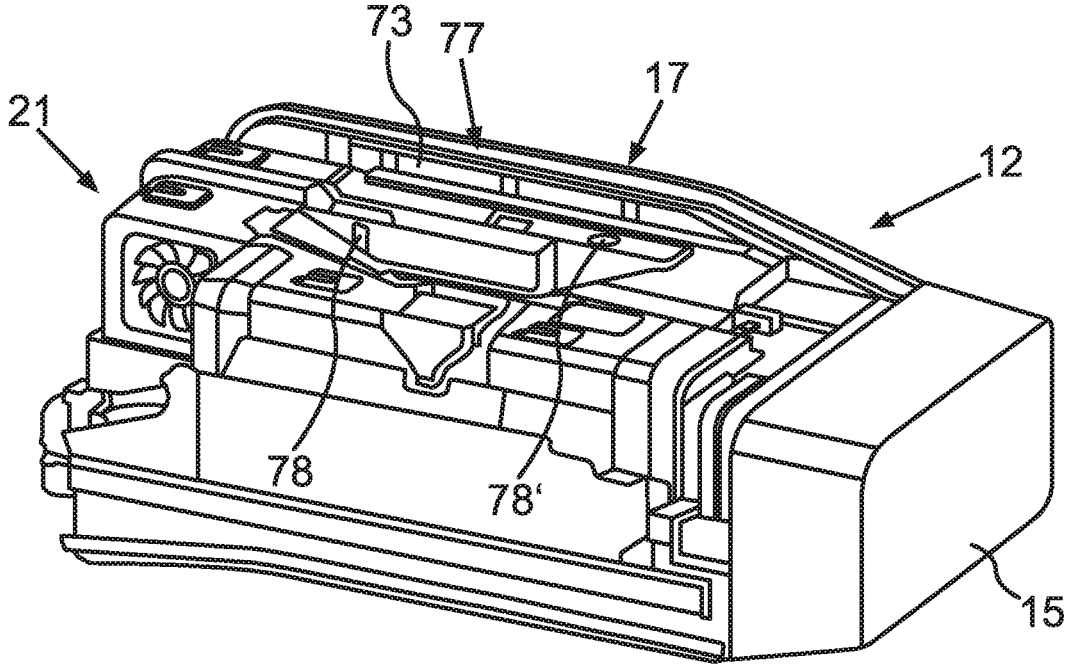
FIG. 10 is a further perspective view of an embodiment of an ice maker.

In FIG. 10 in a further perspective view the ice maker 12 is shown. The component 77 moreover comprises further openings 78, from which the air stream L can exit towards the top. Thereby additionally an air stream can directly reach the ice producer 13. A further opening 78' corresponding with fixation element on the ceiling of the ice compartment 12*a* for mounting of the air guiding duct 66 to the ice compartment 12*a*. The ceiling of the ice compartment 12*a* is a portion of the inner liner of the refrigeration compartment 3.

Figure 11:
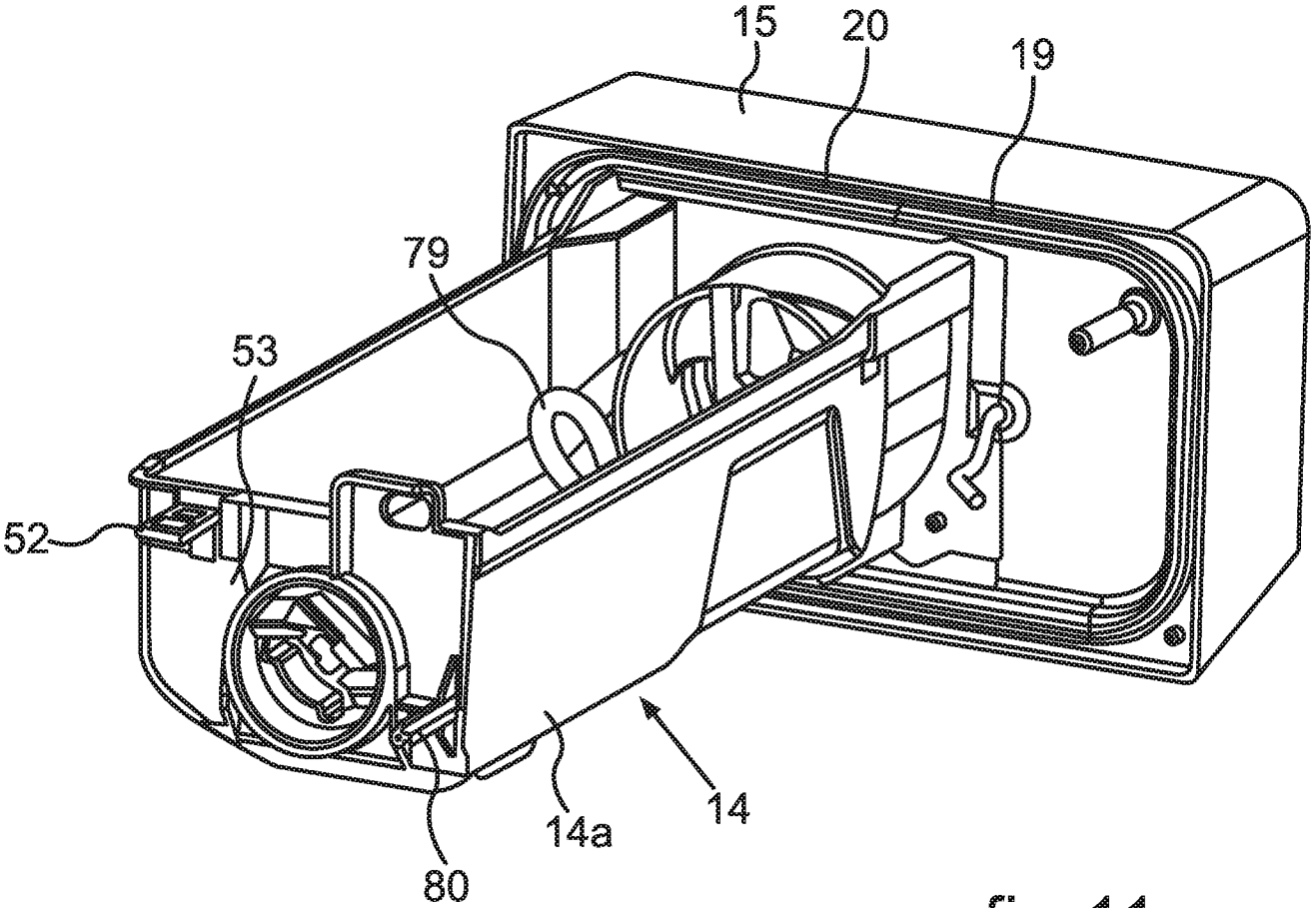
FIG. 11 is a perspective view of partial components of the ice maker.

In FIG. 11 in a perspective view the module with the front wall 15 and the storage container 14 is shown. Here also the storage container 14 is shown. Also, the conveyor 79 is arranged here in the storage container 14. The coupling extension 52 is configured in particular as loop. It thus comprises a frame bounding a recess. This recess is engaged by the gripper 50.

Figure 12:
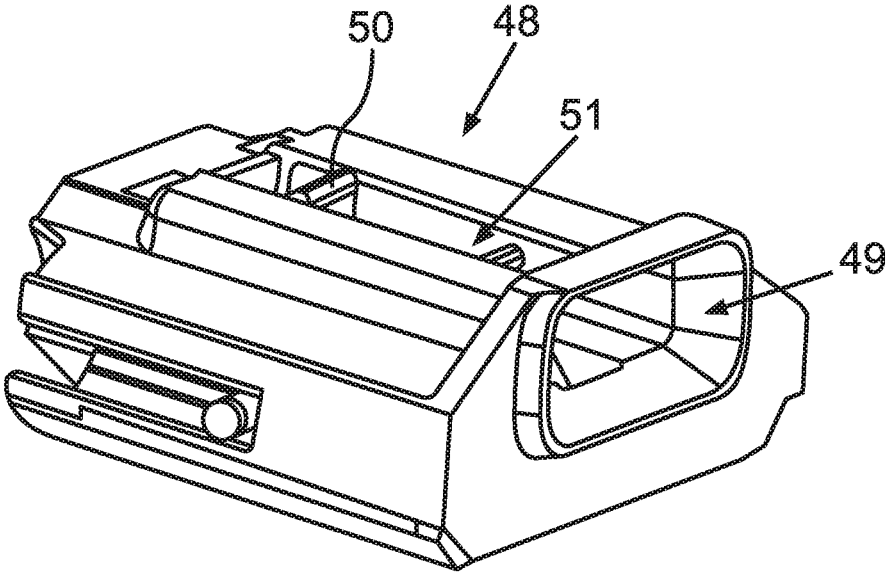
FIG. 12 is a perspective view of a closing aid.

In FIG. 12 in a perspective view the closing aid 48 is shown. The coupling extension 52 is inserted via the insertion opening 49 and then couples to the gripper 50.

Figure 13:
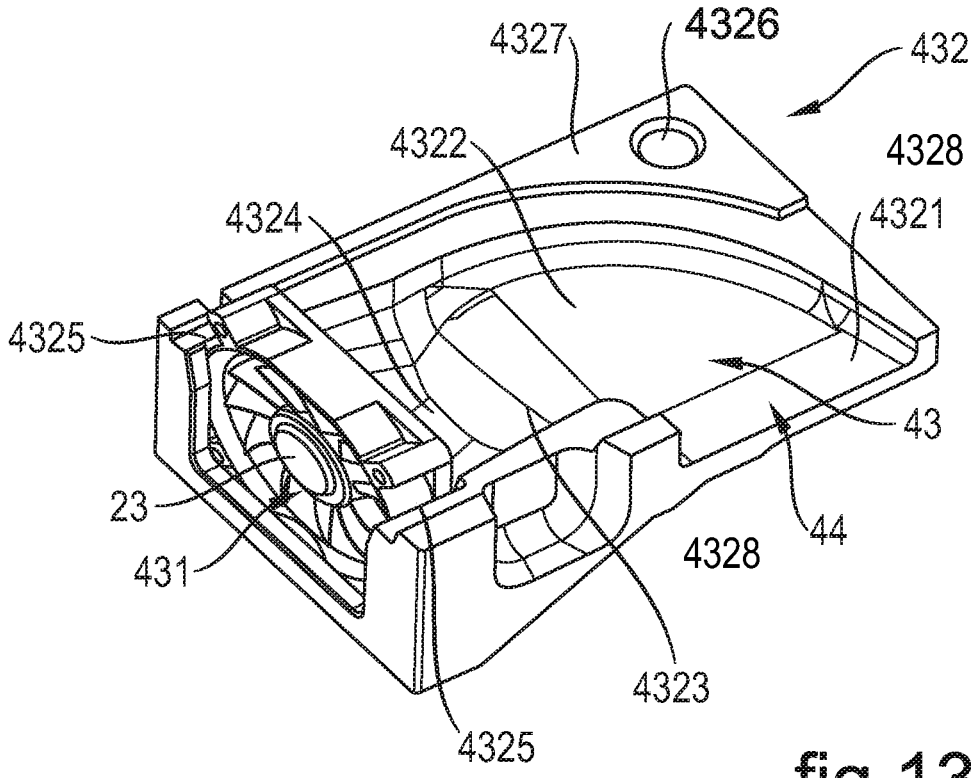
FIG. 13 is a perspective view at a second air duct shell of an air duct of the ice maker.
Figure 14:
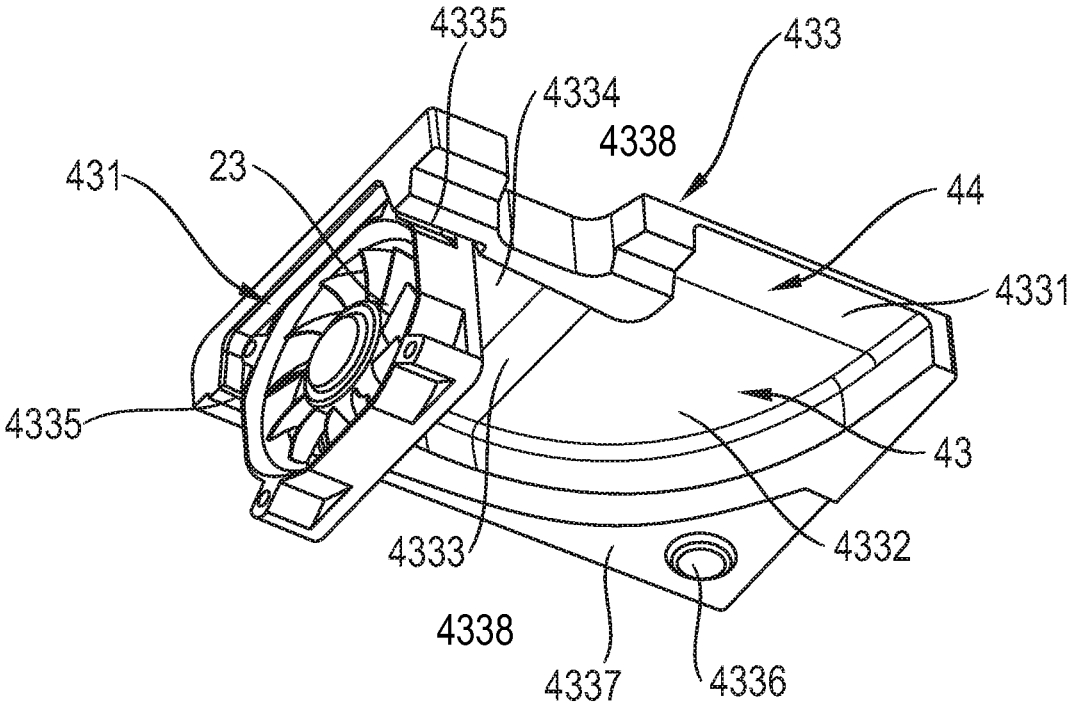
FIG. 14 is a perspective view of a second air duct shell of an air duct of the ice maker.

In FIG. 13 is shown a perspective view of a first air duct shell 432 of the air duct 43 of the ice maker 12. The first air duct shell 432 and corresponding second air duct shell 433, as illustrated in FIG. 14, forming the air duct 43 through which the air stream L flows from the ice producer 13 to the storage container 14 in operation of the household cooling appliance 1. In this illustration, the second air duct shell 433 is removed. The first air duct shell 432 comprises a horizontal wall 4321 from which raise lateral walls 4328 at longitudinal sides of the horizontal wall 4321. The horizontal wall 432 and the lateral walls 4328 of the first air duct shell 432 forming at least partly the volume of the air duct 43 through which the air stream L flows in operation of the ice maker 12. The horizontal wall 4321 and lateral walls 4328 having a U-shaped profile in width direction of the air duct 43 and are preferably formed of one piece. In this illustration, the first air duct shell 432 forms lower part of the air duct 43. Further, is provided an air duct outlet 44 which, in the assembled state of the ice maker 12, faces to said storage container 14 and an air duct inlet 431 which, in the assembled state of the ice maker 12, faces to the ice producer 13. The fan 23 is preferably arranged inside said air duct 43 at the air duct inlet 431 and, in operation of the ice maker 12, the fan 23 generates the air stream L in the ice maker 11 through the air duct 43. In the assembled state, the fan 23 is sandwiched between and surrounded by the first air duct shell 432 and the second air duct shell 433. In the assembled state, the fan 23 is provided partially in a groove 4325 which is formed by the first air duct shell 432 and partially in a groove 4335 formed by the second air duct shell 433, as shown in FIG. 14. The first groove 4325 of the first air duct shell 432 and the second groove 4335 of the second air duct shell 433 corresponding to each other and form together a circumferential groove 4325, 4335 which accommodates and completely surrounds the fan 23. In the assembled state of the ice maker 12, the grooves 4325, 4335 provided in the air duct shells 432, 433 completely surround and hold the fan 23 in position. The first air duct shell 432 and second air duct shell 433 are preferably formed by a material having damping and heat insulation properties, for example extruded polystyrene (EPS), extruded polypropylene (EPP), or any other suitable material. In this way, the fan 23 can be mounted without any further fixing elements, as for example screws or snap-fit connections, and any noise or vibrations caused by the fan 23 are properly damped by the first air duct shell 432 and second air duct shell 433. The lateral walls 4328 of the first air duct shell 432 having a blind hole 4326 which corresponds with a protrusion 4336 of the second air duct shell 433. The first air duct shell 432 and the second air duct 433 shell are plugged together by inserting of the protrusion 4336 into the blind hole 4326. The blind hole 4326 and the protrusion 4336 are preferably form a press-fit connection in the connected state of the first 433 and second air duct shell 432. The blind hole 4326 may also be provided on lateral walls 4338 of the second air duct shell 433 and corresponds with a protrusion 4336 provided on the lateral walls 4328 of the first air duct shell 432. Further, the lateral walls 4328 of the first air duct shell 432 having a raised wall portion 4327 which form a form-fitting connection with a sunken wall portion 4337 provided on a lateral wall 4338 of the second air duct shell 433. The blind hole 4326 is surrounded by the raised wall portion 4327.

Further, the first air duct shell 432 having a first air duct section 4322, a second air duct section 4323, and a third air duct section 4324. In the first air duct section 4322 is provided the air duct outlet 44 and the first air duct section 4322 is curved in an arch shaped manner for guiding the air stream L to said air duct outlet 44. The first air duct section 4322 is preferably curved approximately about 90 degrees and deflects the air stream L coming from air duct inlet 431 provided in the sidewall of the drive housing 22 facing the ice producer 13 and discharged from the air duct outlet 44 in a front wall 24 of the drive housing 22 facing the storage container 14. In the third air duct section 4323 is provided the air duct inlet 431 and the fan 23. The second air duct section 4323 is provided between the first air duct section 4322 and the third air duct section 4323. The second air duct section 4323 having a sloped surface. In this way, the air duct 43 in narrowed in flow cross-section from the air duct inlet 431 to the air duct outlet 44, which means that the air stream L is concentrated in the air duct and turbulences are reduced.

In FIG. 14 is shown a perspective view of the second air duct shell 433 of the air duct 23 of the ice maker 12. The second air duct shell 433 is complementary formed to first air duct shell 432 in order to be fitted together and to form the air duct 23. The second air duct shell 433 form the partial groove 4335 at the air duct inlet 432 to accommodate the fan 23. The partial groove 4335 of the second air duct shell 433 and the partial groove 4325 of the first partial groove 4325 form the circumferential groove, which accommodates and completely surrounds the fan 23. The second air duct shell 433 also has a horizontal wall 4331 from which raises lateral walls 4338 and forming a U-shaped profile in width direction of the air duct 43. Further, the second air duct shell 433 also has a first air duct section 4332 at the air duct outlet, a third air duct section 4334 at the air duct inlet, and a second air duct section 4333 between the first air duct section 4332 and the third air duct section 4334. The second air duct 4333 section having also a sloped surface in order to narrow the flow cross-section of the air duct 43 from the third air duct section 4334 to the first air duct suction 4331 or from the air duct inlet 431 to the air duct outlet 44 respectively. The first air duct section 4332 is curved in an arch shaped manner for guiding the air stream L to said air duct outlet 44. Further, the second air duct shell 433 having a sunken wall portion 4337 on the lateral walls 4338 and, in the assembled state, the sunken wall portion 4337 forms a form-fitting connection with the raised wall portions 4327 provided on the lateral walls 4328 of the first air duct shell 432, as illustrated in FIG. 13. Further, a protrusion 4336 is provided on at least one of the lateral walls 4327 and, in the assembled state, the protrusion 4336 is inserted in the blind hole 4326, as illustrated in FIG. 13, provided on lateral walls 4328 of the first air duct shell 432. Preferably, the connection of the protrusion 4336 and the blind hole 4326 is formed as a press-fit connection. In this illustration, the protrusion 4336 is further surrounded by the sunken wall portion 4337.

The following is a summary list of reference numerals and the corresponding structure used in the above description of the invention:

1 household cooling appliance
2 outer housing
3 refrigeration compartment
4 freezer compartment
5 door
6 door
7 door
8 module
9 output
10 dispenser
11 ice chute
12 ice maker
**12*a*** ice compartment
13 ice producer
14 storage container
**14*a*** outer side
15 front wall
16 outer housing
17 outer housing wall
**17*a*** vertical wall
**17*b*** bottom wall
18 front frame
**18*a*** opening
19 seal
20 rear side
21 driving unit
22 drive housing
23 fan
24 front wall
25 roof wall
26 bottom wall
27 side wall
28 side wall
29 receiving duct
**29*a*** rear end portion
**29*b*** front portion
30 entry
31 exit
32 receiving duct
33 entry
34 exit
35 bounding walls
36 bounding walls
37 throat
38 throat
39 corner portion
40 edge portion
41 corner portion
42 corner portion
43 air duct
431 air duct inlet
432 first air duct shell
4321 horizontal wall
4322 first air duct section
4323 second air duct section
4324 third air duct section
4325 groove
4326 blind hole
4327 lateral wall
433 second air duct shell
4331 horizontal wall
4332 first air duct section
4333 second air duct section
4334 third air duct section
4335 groove
4336 protrusion
4337 sunken wall portion
4338 lateral wall
44 air duct outlet
45 passage
46 shaft
47 coupling entry
48 closing aid

49 insertion opening
50 gripper
51 energy storage
52 coupling extension
53 rear wall
54 cable channel
55 coupling entry
56 coupling entry
57 ceiling wall
58 rear wall
59 inner liner
60 reinforcement part
61 reinforcement part
62 coupling element
63 coupling element
64 drive motor
65 opening
66 air guiding duct
66*a* front end
66*b* rear end
67 duct wall
68 duct wall
69 opening
70 opening
71 opening
72 bottom wall
73 flange
74 part
75 part
76 part
77 component
78 opening
78' opening
79 conveyor
80 counter coupler
A longitudinal axis
B longitudinal axis
L air stream

The invention claimed is:

1. An ice maker for mounting into a household cooling appliance, the ice maker comprising:

an ice producer for producing ice;

a storage container for storing the ice;

a driving unit for driving said storage container, said driving unit having a drive housing with a front wall facing said storage container and a side wall facing said ice producer;

an air duct arranged in said drive housing, said air duct having an air duct outlet formed in said front wall which faces said storage container and an air duct inlet formed in said side wall which faces said ice producer;

a fan arranged in said air duct and configured to generate an air stream from said ice producer to said storage container through said air duct; and an air guiding duct disposed above said storage container in a height direction of said ice maker for further guiding the air stream exiting from said air duct outlet, said air guiding duct being bounded by a first lateral duct wall that is oriented in the depth direction of the ice maker and extends in the height direction, and said air guiding duct being bounded by a second duct wall, being a roof wall.

2. The ice maker according to claim 1, wherein said air duct is curved, at least in portions thereof, in an arch shape for guiding the air stream from said air duct inlet to said air duct outlet.

3. The ice maker according to claim 1, wherein said air duct is positioned above a drive motor in said drive housing.

4. The ice maker according to claim 1, wherein said fan is mounted inside said air duct and at said air duct inlet.

5. The ice maker according to claim 1, wherein said air duct comprises a first air duct shell and a second air duct shell, and wherein said first air duct shell and said second air duct shell form said air duct.

6. The ice maker according to claim 5, wherein said first air duct shell and said second air duct shell have a U-shaped form respectively and are connected together by plug connections which are integrally formed with said first air duct shell and said second air duct shell.

7. The ice maker according to claim 5, wherein said fan is sandwiched between said first duct shell and said second air duct shell, and wherein said fan is disposed in a circumferential groove formed by said first air duct shell and said second air duct shell.

8. The ice maker according to claim 1, wherein said air duct is narrowed in flow cross-section from said air duct inlet to said air duct outlet.

9. The ice maker according to claim 1, wherein said air guiding duct has at least one first opening that is open towards a bottom side in the height direction to enable the air stream streaming in said air guiding duct to escape towards the bottom from said air guiding duct.

10. The ice maker according to claim 9, wherein said at least one first opening of said air guiding duct is offset in a width direction of the ice maker so that said air stream exiting from said at least one first opening of said air guiding duct flows along said storage container on the outer side back to the ice producer.

11. The ice maker according to claim 10, wherein the air stream exiting from said opening of said air guiding duct flows along an outer side of a first side wall of said storage container and an outer side of a bottom wall of said storage container and an outer side of a second side wall of said storage wall, wherein said bottom wall is opposite said opening of said storage container that is accessible from above.

12. The ice maker according to claim 1, wherein at least said first lateral duct wall and said roof wall are configured to guide said air stream in said air guiding duct in a depth direction of the ice maker.

13. The ice maker according to claim 12, wherein said air guiding duct, in the width direction of the ice maker, is arranged to overlap in portions in an overlapping area with said opening of said storage container, wherein said air guiding duct includes a bottom wall, by which the opening of said storage container is covered from the top in the overlapping area.

14. The ice maker according to claim 1, wherein said first lateral duct wall and said roof wall are a single-piece duct part.

15. The ice maker according to claim 1, wherein said first lateral duct wall is curved, at least in portions thereof, in an arch shape.

16. The ice maker according to claim 1, wherein said first lateral duct wall, viewed in a depth direction, is curved in a rear shell of a length thereof towards the interior of the ice maker.

17. The ice maker according to claim 16, further comprising an outer housing wall forming said second lateral duct wall.

18. The ice maker according to claim 16, wherein said roof wall comprises a contact flange in direct contact with said second lateral duct wall.

19. The ice maker according to claim 1, wherein said air guiding duct comprises a second lateral duct wall, which bounds said air guiding duct at a side opposite said first lateral duct wall.

20. The ice maker according to claim 1, wherein said air guiding duct comprises a rear end and an opposite front end, and said air guiding duct is narrowed from said rear end towards said front end.

21. The ice maker according to claim 1, wherein said air guiding duct has a rear end connected to said drive housing.

22. The ice maker according to claim 1, wherein said air guiding duct is arranged at said drive housing by a stick connection.

23. The ice maker according to claim 1, wherein said at least one first opening of said air guiding duct is formed in said bottom wall, and in the width direction is arranged external to the overlapping area.

24. The ice maker according to claim 1, wherein said ice maker forms an ice compartment arranged in a refrigeration compartment of the household cooling appliance.

25. A household cooling appliance, comprising:

an ice maker having:

an ice producer for producing ice;

a storage container for storing the ice;

a driving unit for driving said storage container, said driving unit having a drive housing with a front wall facing said storage container and a side wall facing said ice producer;

an air duct formed in said drive housing, said air duct having an air duct outlet in said front wall which faces said storage container and an air duct inlet in said side wall of said drive housing which faces said ice producer;

a fan arranged in said air duct and configured to generate an air stream from said ice producer to said storage container through said air duct; and an air guiding duct disposed above said storage container in a height direction of said ice maker for further guiding the air stream exiting from said air duct outlet, said air guiding duct being bounded by a first lateral duct wall that is oriented in the depth direction of the ice maker and extends in the height direction, and said air guiding duct being bounded by a second duct wall, being a roof wall.

* * * * *